US011167947B2

(12) United States Patent
Nishimura

(10) Patent No.: US 11,167,947 B2
(45) Date of Patent: Nov. 9, 2021

(54) IMAGE FORMING APPARATUS

(71) Applicant: KYOCERA Document Solutions Inc., Osaka (JP)

(72) Inventor: Takatoshi Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 165 days.

(21) Appl. No.: 16/459,030

(22) Filed: Jul. 1, 2019

(65) Prior Publication Data

US 2020/0010296 A1 Jan. 9, 2020

(30) Foreign Application Priority Data

Jul. 4, 2018 (JP) ..... JP2018-127545

(51) Int. Cl.

| | |
|---|---|
| ***B65H 7/08*** | (2006.01) |
| ***B65H 9/00*** | (2006.01) |
| ***B65H 5/36*** | (2006.01) |
| ***B65H 9/16*** | (2006.01) |
| ***B65H 5/06*** | (2006.01) |

(52) U.S. Cl.

CPC ..... *B65H 9/166* (2013.01); *B65H 5/062* (2013.01); *B65H 7/08* (2013.01); *B65H 9/002* (2013.01); *B65H 5/36* (2013.01); *B65H 2404/14212* (2013.01); *B65H 2404/6111* (2013.01); *B65H 2511/216* (2013.01); *B65H 2701/1311* (2013.01)

(58) Field of Classification Search

CPC ..... B65H 9/002; B65H 7/08; B65H 2404/14212; B65H 2404/6112

USPC ..... 271/9.12

See application file for complete search history.

(56) References Cited

U.S. PATENT DOCUMENTS

| | | | | |
|---|---|---|---|---|
| 10,530,950 | B2 * | 1/2020 | Watanabe | B65H 9/002 |
| 2005/0082737 | A1 * | 4/2005 | Sasaki | G03G 15/6508 271/9.12 |
| 2019/0241385 | A1 * | 8/2019 | Kaneko | B65H 9/002 |

FOREIGN PATENT DOCUMENTS

JP 2002-189115 A 7/2002

* cited by examiner

*Primary Examiner* — Patrick Cicchino

(74) *Attorney, Agent, or Firm* — Studebaker & Brackett PC

(57) ABSTRACT

An image forming apparatus includes a main body, a feeder, and a relay device. The main body forms an image on a sheet. The feeder feeds the sheet toward the main body. The relay device connects the main body to the feeder. The main body is placed on a placement surface. The feeder is arranged opposite to the main body with the relay device therebetween in a direction along the placement surface. The relay device includes a conveyance unit and a casing which houses the conveyance unit. The conveyance unit conveys the sheet fed from the feeder to the main body and rotates relative to the casing with an axis as a pivot thereof. The axis extends in a cross direction intersecting with the placement surface.

8 Claims, 9 Drawing Sheets

IMAGE FORMING APPARATUS

INCORPORATION BY REFERENCE

The present application claims priority under 35 U.S.C. § 119 to Japanese Patent Application No. 2018-127545, filed on Jul. 4, 2018. The contents of this application are incorporated herein by reference in their entirety.

BACKGROUND

The present disclosure relates to an image forming apparatus.

A production apparatus is known that attaches ink to a colored substrate to produce a color filter. A color filter production apparatus as such a production apparatus includes a horizontal means of adjustment in the vicinity of an imaging head. The horizontal means of adjustment moves a coloring surface of the colored substrate in a horizontal direction relative to an imaging head. In the color filter production apparatus, a position of the coloring surface can be adjusted relative to the position of the imaging head.

SUMMARY

An image forming apparatus according to an aspect of the present disclosure includes a main body, a feeder, and a relay device. The main body forms an image on a sheet. The feeder feeds the sheet toward the main body. The relay device connects the main body to the feeder. The main body is placed on a placement surface. The feeder is arranged opposite to the main body with the relay device therebetween in a direction along the placement surface. The relay device includes a conveyance unit and a casing which houses the conveyance unit. The conveyance unit conveys the sheet fed from the feeder to the main body and rotates relative to the casing with an axis as a pivot thereof. The axis extends in a cross direction intersecting with the placement surface.

DETAILED DESCRIPTION

Figure 1:
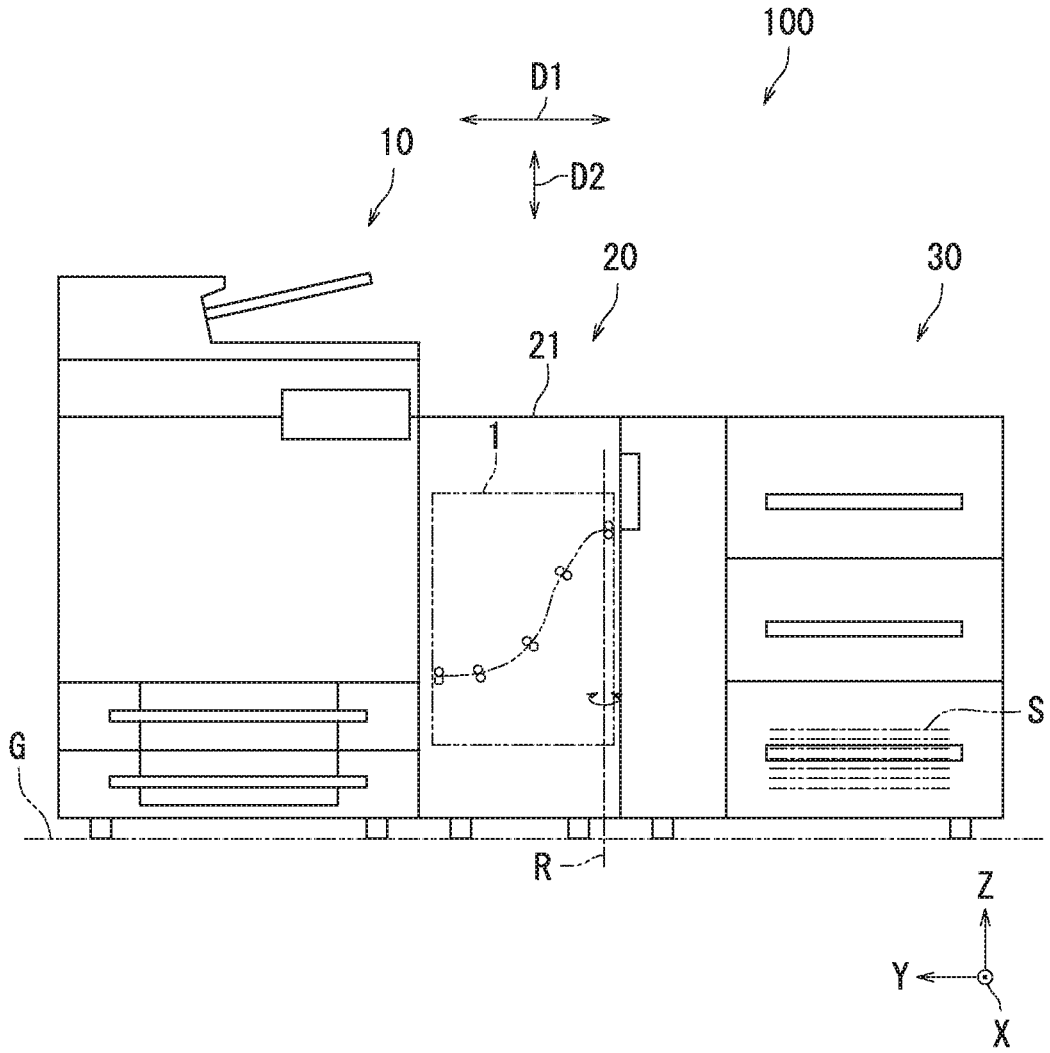
FIG. 1 is a diagram illustrating an image forming apparatus according to an embodiment of the present disclosure.

The following describes an embodiment of the present disclosure with reference to the accompanying drawings. Elements that are the same or equivalent are labelled with the same reference signs in the drawings and description thereof is not repeated. According to the present embodiment, X and Y axes are parallel to a horizontal plane and a Z axis is parallel to a vertical axis. The X, Y, and Z axes are mutually orthogonal. "Up" and "down" in the present specification respectively indicate "up" and "down" in the direction of the vertical axis unless particularly specified otherwise.

The following describes an image forming apparatus 100 according to the embodiment of the present disclosure with reference to FIG. 1. FIG. 1 is a diagram illustrating the image forming apparatus 100. The image forming apparatus 100 is a printer, a copier, or a multifunction peripheral, for example. In the following, an example is described in which the image forming apparatus 100 is an electrographic color multifunction peripheral. The image forming apparatus 100 is placed on a floor, for example. The image forming apparatus 100 includes a main body 10, a feeder 30, and a relay device 20.

The main body 10 forms an image on a sheet S. The main body 10 is placed on a placement surface G. The placement surface G is an upper surface of a floor, for example. The placement surface G is preferably parallel to a horizontal plane.

The feeder 30 feeds the sheet S toward the main body 10. The feeder 30 is arranged opposite to the main body 10 with the relay device 20 therebetween in a direction D1 (referred to as a "placement surface direction D1" in the following) along the placement surface G. The main body 10, the relay device 20, and the feeder 30 may each be fixed to the placement surface G.

In general, in an image forming apparatus which forms an image on a conveyed sheet, the sheet may skew before being conveyed to a main body in a case where the main body and a feeder of the sheet are arranged side by side on a placement surface. There is a demand for such an image forming apparatus that performs appropriate adjustment of the position of the sheet conveyed to an image forming unit.

The relay device 20 connects the main body 10 to the feeder 30. The relay device 20 includes a casing 21 and a conveyance unit 1. The casing 21 houses the conveyance unit 1. The conveyance unit 1 conveys, or relays, the sheet S fed from the feeder 30 to the main body 10. The conveyance unit 1 rotates relative to the casing 21 with an axis R as a pivot thereof. The axis R extends in a cross direction D2 intersecting with the placement surface G.

According to the present embodiment as described above with reference to FIG. 1, the main body 10 forms an image on the sheet S. The feeder 30 is arranged opposite to the main body 10 with the relay device 20 therebetween in the placement surface direction D1. The relay device 20 connects the main body 10 to the feeder 30. The conveyance unit 1 of the relay device 20 conveys the sheet S fed from the feeder 30 to the main body 10. The conveyance unit 1 rotates relative to the casing 21 with the axis R as a pivot thereof. As such, the image forming apparatus 100 can rotate the conveyance unit 1 to change the conveyance direction of the sheet S fed from the feeder 30. Accordingly, a skew of the sheet S fed from the feeder 30 can be easily corrected without moving the main body 10 and the feeder 30 arranged side by side to each other.

Figure 2:
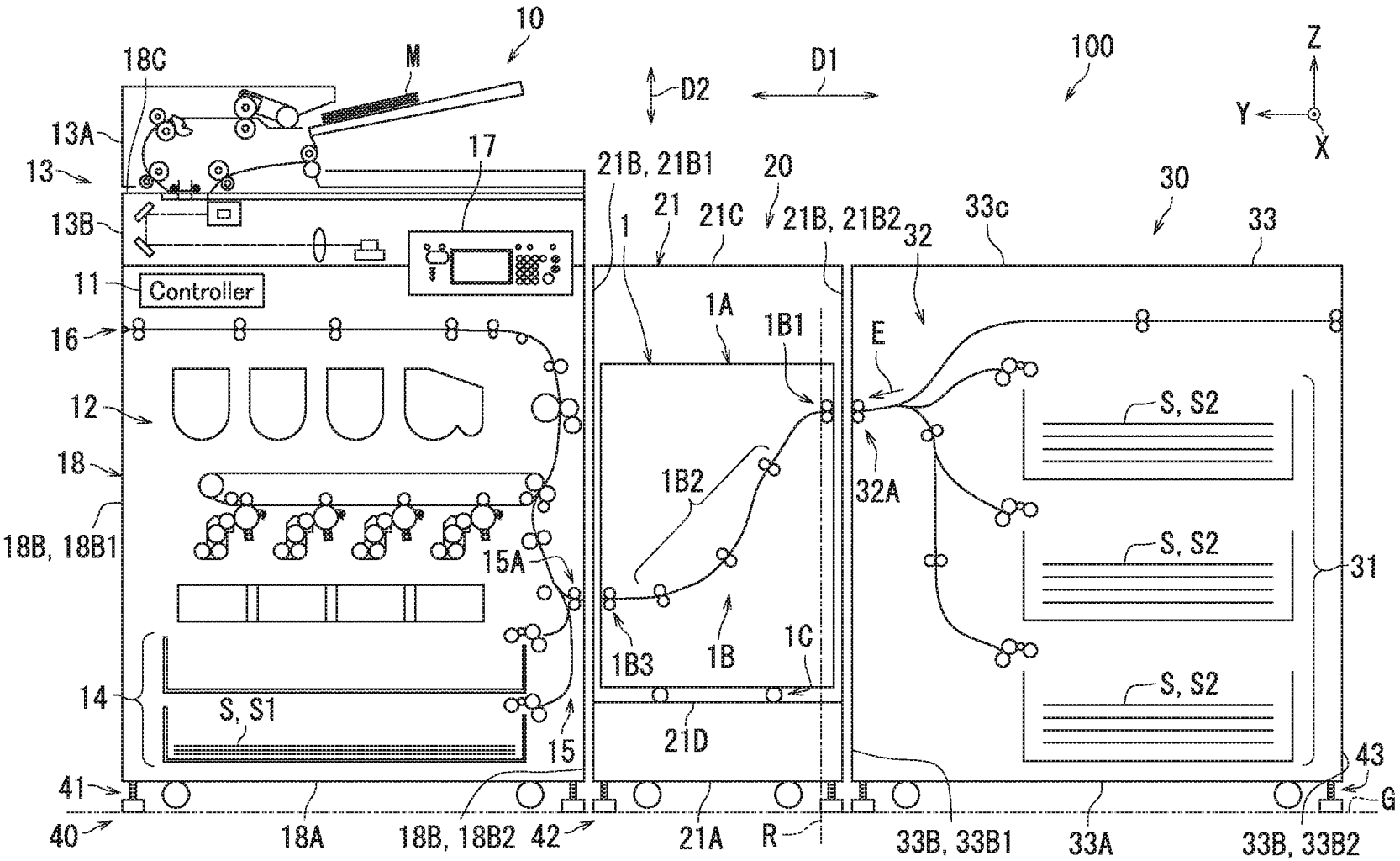
FIG. 2 is a diagram illustrating the image forming apparatus according to the embodiment of the present disclosure.

The following describes the configuration of the feeder 30, the relay device 20, and the main body 10 in detail with reference to FIG. 2. FIG. 2 is a diagram illustrating the image forming apparatus 100.

The feeder 30 feeds the sheet S toward the main body 10. The feeder 30 is an optional device such as a large paper feeding deck. In detail, the feeder 30 includes a feeder paper feed section 31, a feeder conveyance section 32, and a feeder casing 33.

The feeder paper feed section 31 includes one or more cassettes and sheet feed roller groups. The cassettes house a plurality of sheets S. The sheet feed roller groups feed the sheets S housed in the cassettes a sheet at a time. The sheets S are made from paper or synthetic resin, for example. In the following, a sheet S to be fed from the feeder 30 is referred to as a "sheet S2". The number of sheets S2 that the feeder 30 can house is 3,000, for example.

The feeder conveyance section 32 conveys a sheet S2 out of the feeder casing 33. The feeder conveyance section 32 conveys the sheet S2 from the feeder paper feed section 31 to the relay device 20, for example. The feeder conveyance section 32 includes a plurality of conveyance rollers and guide members, and functions as a conveyance path.

The feeder casing 33 is arranged opposite to the main body 10 with the relay device 20 therebetween in the placement surface direction D1. In detail, the feeder casing 33 houses the feeder paper feed section 31 and the feeder conveyance section 32. The feeder casing 33 is substantially rectangular parallelepiped-shaped, for example. The feeder casing 33 includes a feeder bottom wall section 33A, a feeder side wall section 33B, and a feeder top wall section 33C.

The feeder bottom wall section 33A constitutes a bottom wall of the feeder casing 33. The feeder side wall section 33B stands from all sides of the feeder bottom wall section 33A. The feeder side wall section 33B includes a first feeder side wall section 33B1 and a second feeder side wall section 33B2. The first feeder side wall section 33B1 is located opposite to the relay device 20. An end portion 32A of the feeder conveyance section 32 is located on the first feeder side wall section 33B1. The end portion 32A is an end portion downstream of the feeder conveyance section 32 in a conveyance direction E. The second feeder side wall section 33B2 is located opposite to the first feeder side wall section 33B1 with the feeder paper feed section 31 and the feeder conveyance section 32 therebetween. The feeder top wall section 33C is connected to an upper end portion of the feeder side wall section 33B and constitutes a top wall of the feeder casing 33.

The relay device 20 is an optional device that connects the main body 10 to the feeder 30. The relay device 20 is an attachment kit, for example. The relay device 20 includes the casing 21 and the conveyance unit 1, as described previously with reference to FIG. 1.

The casing 21 houses the conveyance unit 1. In detail, the casing 21 is substantially rectangular parallelepiped-shaped, for example. The casing 21 is placed on the placement surface G. The casing 21 includes a relay bottom wall section 21A, a relay side wall section 21B, a relay top wall section 21C, and a base member 21D. The relay bottom wall section 21A, the relay side wall section 21B, and the relay top wall section 21C each include a frame member and an exterior member which covers the outer surface of the frame member.

The relay bottom wall section 21A constitutes a bottom wall of the casing 21. The relay bottom wall section 21A extends in a direction parallel to the placement surface G. The relay side wall section 21B stands from all sides of the relay bottom wall section 21A. The relay side wall section 21B includes a first relay side wall section 21B1 and a second relay side wall section 21B2. The first relay side wall section 21B1 is located opposite to the main body 10. The second relay side wall section 21B2 is located opposite to the first relay side wall section 21B1 with the conveyance unit 1 therebetween. The relay top wall section 21C is connected to an upper end portion of the relay side wall section 21B and constitutes a top wall of the casing 21.

The base member 21D is located between the relay bottom wall section 21A and the relay top wall section 21C, and extends in a direction intersecting with the relay side wall section 21B. The base member 21D is a rectangular shaped plate member, for example. The conveyance unit 1 is placed on the base member 21D. That is, the base member 21D functions as a shelf parallel to the placement surface G, and can determine the location of the conveyance unit 1 in a height direction thereof.

The conveyance unit 1 conveys the sheet S2 fed from the feeder 30 to the main body 10. The conveyance unit 1 rotates relative to the casing 21 with the axis R as a pivot thereof. In detail, the conveyance unit 1 includes a conveyance unit casing 1A, a relay conveyance section 1B, and swinging members 1C.

The conveyance unit casing 1A houses the relay conveyance section 1B. The configuration of the conveyance unit casing 1A is described later in detail with reference to FIGS. 3A, 3B, 6A, and 6B.

The relay conveyance section 1B includes an inward conveyance section 1B1, an intermediate conveyance section 1B2, and an outward conveyance section 1B3. The inward conveyance section 1B1, the intermediate conveyance section 1B2, and the outward conveyance section 1B3 each include conveyance rollers and guide members, and function as a conveyance path. The inward conveyance section 1B1 is located opposite to the second relay side wall section 21B2. The sheet S2 conveyed from the feeder conveyance section 32 is conveyed into the inward conveyance section 1B1. The intermediate conveyance section 1B2 conveys the sheet S2 conveyed into the inward conveyance section 1B1 to the outward conveyance section 1B3. The outward conveyance section 1B3 is located opposite to the first relay side wall section 21B1. The outward conveyance section 1B3 conveys the sheet S2 conveyed from the intermediate conveyance section 1B2 out to the main body 10.

The swinging members 1C are located respectively at four lower corners of the conveyance unit casing 1A and opposite to the base member 21D. The swinging members 1C swing the upper portion of the base member 21D according to the rotation of the conveyance unit 1 with the axis R as a pivot thereof. The swinging members 1C are rollers or casters, for example. The axis R extends in the cross direction D2 intersecting with the placement surface G. The cross direction D2 is for example a direction orthogonal to the rotary shaft of each conveyance roller of the relay conveyance section 1B. The axis R is an axis crossing the center of the inward conveyance section 1B1 in the cross direction D2, for example.

The main body 10 includes an input display section 17, a controller 11, storage (not illustrated), a reading section 13, a main body feeding section 14, a main body conveyance section 15, an image forming section 12, an ejection section 16, and a main body casing 18.

The input display section 17 includes a display with a touch panel function and various hardware buttons. The input display section 17 is an operation panel, for example.

Various instructions according to user operation are input to the input display section 17. The various instructions are for example reading and printing instructions for a document M or various setting instructions. The display is a liquid-crystal display or an organic electroluminescent (EL) display, for example.

The controller 11 is a hardware circuit including a processor such as a central processing unit (CPU). The controller 11 controls operation of each section and each device of the image forming apparatus 100 through the processor reading out and executing a control program stored in the storage. The processor also reads out and executes application programs stored in the storage. The controller 11 also controls a rotational driving section of the relay device 20 based on a result of detection by a detector of the relay device 20. The detector and the rotational driving section are described later in detail with reference to FIGS. 7 and 8.

The storage includes a hard disk drive (HDD), random-access memory (RAM), and read-only memory (ROM), for example. The storage stores therein various data, the control program, and the application programs. The various data includes image data, for example. The control program is a program for controlling the operation of each section and each device of the image forming apparatus 100, and is executed by the controller 11.

The reading section 13 includes a document conveyor device 13A and a scanner reading section 13B (optical system). The document M is placed on a tray or document loading plate of the document conveyor device 13A. The reading section 13 reads an image from the document M according to a reading and printing instruction. The reading section 13 generates image data from the read image.

The main body feeding section 14 includes at least one cassette and sheet feed roller group. The cassette houses a plurality of sheets S. The sheet feed roller groups feed the sheets S housed in the cassette a sheet at a time. In the following, a sheet S fed from the main body feeding section 14 is referred to as a "sheet S1". The main body feeding section 14 feeds the sheet S1 to the main body conveyance section 15.

The main body conveyance section 15 includes a main body inward conveyance section 15A, conveyance rollers, and guide members. The main body conveyance section 15 functions as a conveyance path. The sheet S2 conveyed from the outward conveyance section 1B3 is conveyed into the main body inward conveyance section 15A. The main body conveyance section 15 conveys the sheets S, S1, and S2 to the image forming section 12.

The image forming section 12 forms an image on a sheet S. In detail, the image forming section 12 includes a photosensitive drum, a charger, an exposure device, a development device, a replenishing device, a transfer device, a cleaning device, a static elimination device, and a fixing device. The image forming section 12 forms an image (an image indicated by image data, for example) on the sheet S electrographically and fixes the image to the sheet S by applying heat and pressure to the image.

The main body conveyance section 15 conveys the sheet S with the image fixed thereto to the ejection section 16. The ejection section 16 ejects the sheet S out of the image forming apparatus 100.

The main body casing 18 houses the controller 11, the scanner reading section 13B, the main body feeding section 14, the main body conveyance section 15, the image forming section 12, the ejection section 16, and the storage. The main body casing 18 is substantially rectangular parallelepiped-shaped. In detail, the main body casing 18 includes a main body bottom wall section 18A, a main body side wall section 18B, and a main body top wall section 18C.

The main body bottom wall section 18A constitutes a bottom wall of the main body casing 18. The main body side wall section 18B stands from all sides of the main body bottom wall section 18A. The main body side wall section 18B includes a first main body side wall section 18B1 and a second main body side wall section 18B2. The first main body side wall section 18B1 is located opposite to the second main body side wall section 18B2 with the image forming section 12 therebetween. The second main body side wall section 18B2 is located opposite to the relay device 20. That is, the second main body side wall section 18B2 is located opposite to the main body inward conveyance section 15A. The main body top wall section 18C is connected to an upper end portion of the main body side wall section 18B and constitutes a top wall of the main body casing 18.

According to the present embodiment as described above with reference to FIG. 2, the main body 10 may include the base member 21D. The conveyance unit 1 may include the swinging members 1C. Therefore, the conveyance unit 1 can be smoothly rotated with the axis R as a pivot thereof.

As illustrated in FIG. 2, it is preferable that the image forming apparatus 100 further include movement inhibiting sections 40 in addition to the main body 10, the relay device 20, and the feeder 30. In detail, the movement inhibiting sections 40 are adjusters, for example. The movement inhibiting sections 40 include main body movement inhibiting sections 41, relay movement inhibiting sections 42, and feeder movement inhibiting sections 43. The main body movement inhibiting sections 41 are located respectively on four corners of the main body bottom wall section 18A and opposite to the placement surface G. The relay movement inhibiting sections 42 are located respectively on four corners of the relay bottom wall section 21A and opposite to the placement surface G. The feeder movement inhibiting sections 43 are located respectively on four corners of the feeder bottom wall section 33A and opposite to the placement surface G.

The main body movement inhibiting sections 41, the relay movement inhibiting sections 42, and the feeder movement inhibiting sections 43 each include for example a screw mechanism with a male screw and a female screw. A lower end of each movement inhibiting section 40 extends toward the placement surface G through loosening of a threaded state thereof and presses against the placement surface G. When the movement inhibiting sections 40 press against the placement surface G, leg members (rollers or casters, for example) respectively located on lower surface corners of the main body bottom wall section 18A, the relay bottom wall section 21A, and the feeder bottom wall section 33A separate from the placement surface G.

The movement inhibiting sections 40 inhibit movement of the main body 10, the relay device 20, and the feeder 30 on the placement surface G in a direction along the placement surface G. Therefore, the main body 10, the relay device 20, and the feeder 30 may each be fixed to the placement surface G. Accordingly, each device can be prevented from being unintentionally moved and becoming offset from the arrangement of the image forming apparatus 100 when the user touches the image forming apparatus 100. As a result, the main body 10 and the feeder 30 arranged side by side can be secured in the arrangement while enabling simple skew correction on the sheet S without causing each device to be offset from each other.

The following describes the configuration of the conveyance unit 1 and the casing 21 in detail with reference to FIG.

Figure 3A:
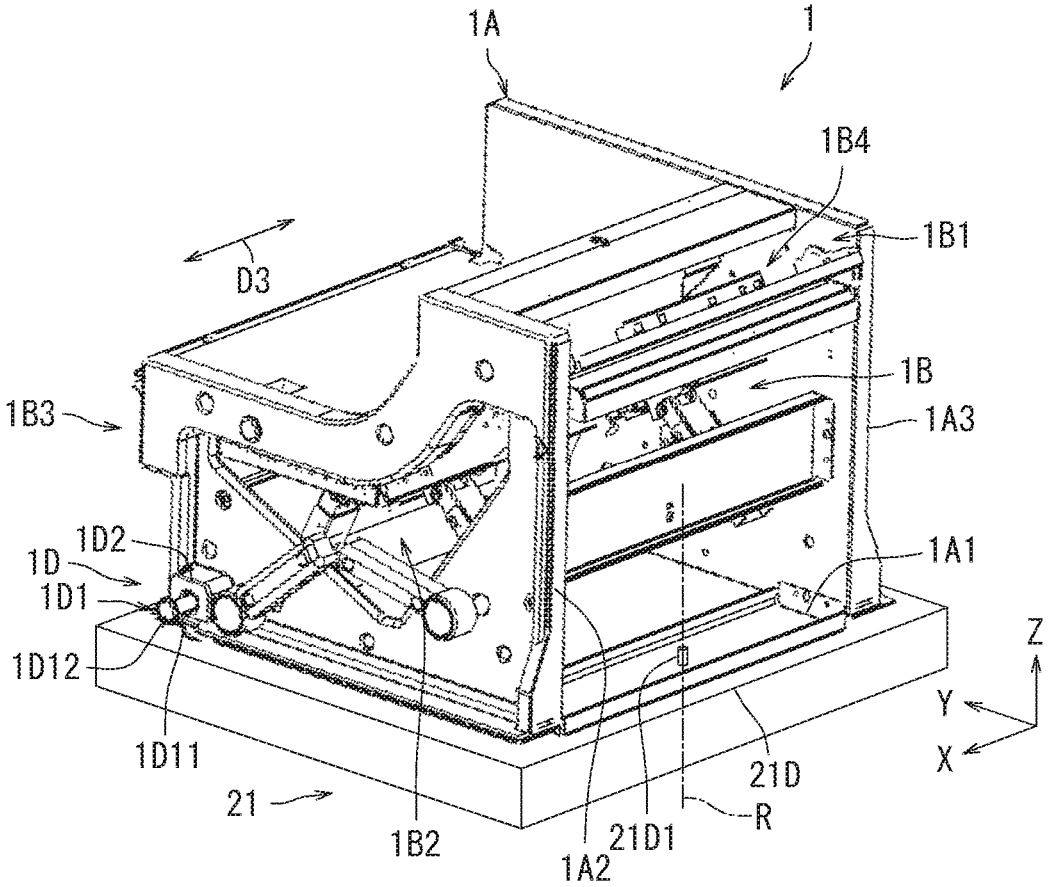
FIG. 3A is a perspective view of a portion of a conveyance unit and a casing of a relay device.

2 and further reference to FIGS. 3A to 6B. FIG. 3A is a perspective view of a portion of the conveyance unit 1 and the casing 21. FIG. 3B is an enlarged perspective view of a portion of the conveyance unit 1 and the casing 21.

As illustrated in FIG. 3A, the conveyance unit casing 1A includes a first frame member 1A1, a second frame member 1A2, and a third frame member 1A3. The first frame member 1A1 extends along a rotational axis of a conveyance roller 1B4 and constitutes a lower portion of the conveyance unit casing 1A. The second frame member 1A2 and the third frame member 1A3 respectively stand from either end of the first frame member 1A1 in the longitudinal direction thereof with the relay conveyance section 1B therebetween. The second frame member 1A2 and the third frame member 1A3 respectively support either end of a rotary shaft of the conveyance roller 1B4. The second frame member 1A2 and the third frame member 1A3 are for example respectively located on front and back sides as viewed from a side in FIG. 2.

The base member 21D includes a shaft member 21D1. The shaft member 21D1 protrudes from an upper surface of the base member 21D. The shaft member 21D1 is for example located below the inward conveyance section 1B1 and at the center of the first frame member 1A1 in the longitudinal direction thereof in a state in which the conveyance unit 1 is placed on the base member 21D. The shaft member 21D1 extends in a direction along the axis R.

The conveyance unit 1 includes a rotation adjustment section 1D. The rotation adjustment section 1D adjusts the rotation of the conveyance unit 1 that rotates with the axis R as a pivot thereof. Specifically, the rotation adjustment section 1D is located below the outward conveyance section 1B3 and at a lower corner of the second frame member 1A2. The rotation adjustment section 1D includes a male screw member 1D1 and a female screw member 1D2. The male screw member 1D1 is a bolt, for example. The male screw member 1D1 is freely threadable to the female screw member 1D2 and extends in a rotational axis direction D3 of the conveyance roller 1B4. In detail, the male screw member 1D1 includes a head 1D12 and a screw 1D11. The head 1D12 is a substantially disc-shaped or angular member protruding from one end of the screw 1D11. The screw 1D11 extends from the head 1D12 toward the female screw member 1D2 in the rotational axis direction D3. The male screw member 1D1 is freely rotatable with the screw 1D11 as an axis thereof.

Figure 3B:
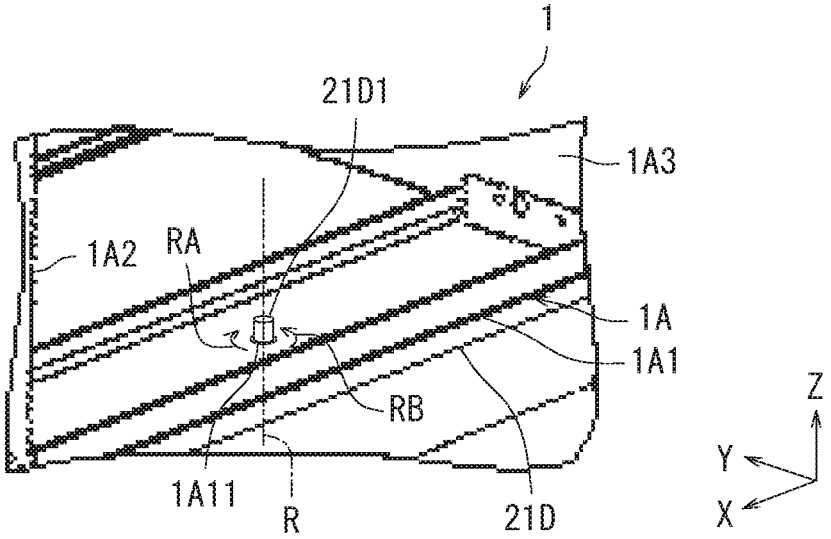
FIG. 3B is an enlarged perspective view of a portion of the conveyance unit and the casing.

As illustrated in FIG. 3B, the first frame member 1A1 has an insertion hole 1A11. The insertion hole 1A11 is formed corresponding to the position and shape of the shaft member 21D1. The insertion hole 1A11 is for example located below the inward conveyance section 1B1 and at the center of the first frame member 1A1 in the longitudinal direction thereof in a state in which the conveyance unit 1 is placed on the base member 21D. The shaft member 21D1 is rotatably inserted into the insertion hole 1A11. The conveyance unit 1 may rotate in a first rotational direction RA and a second rotational direction RB with the shaft member 21D1 as a pivot thereof. The first rotational direction RA is a clockwise direction as viewed in plan. The second rotational direction RB is a counterclockwise direction as viewed in plan.

Figure 4A:
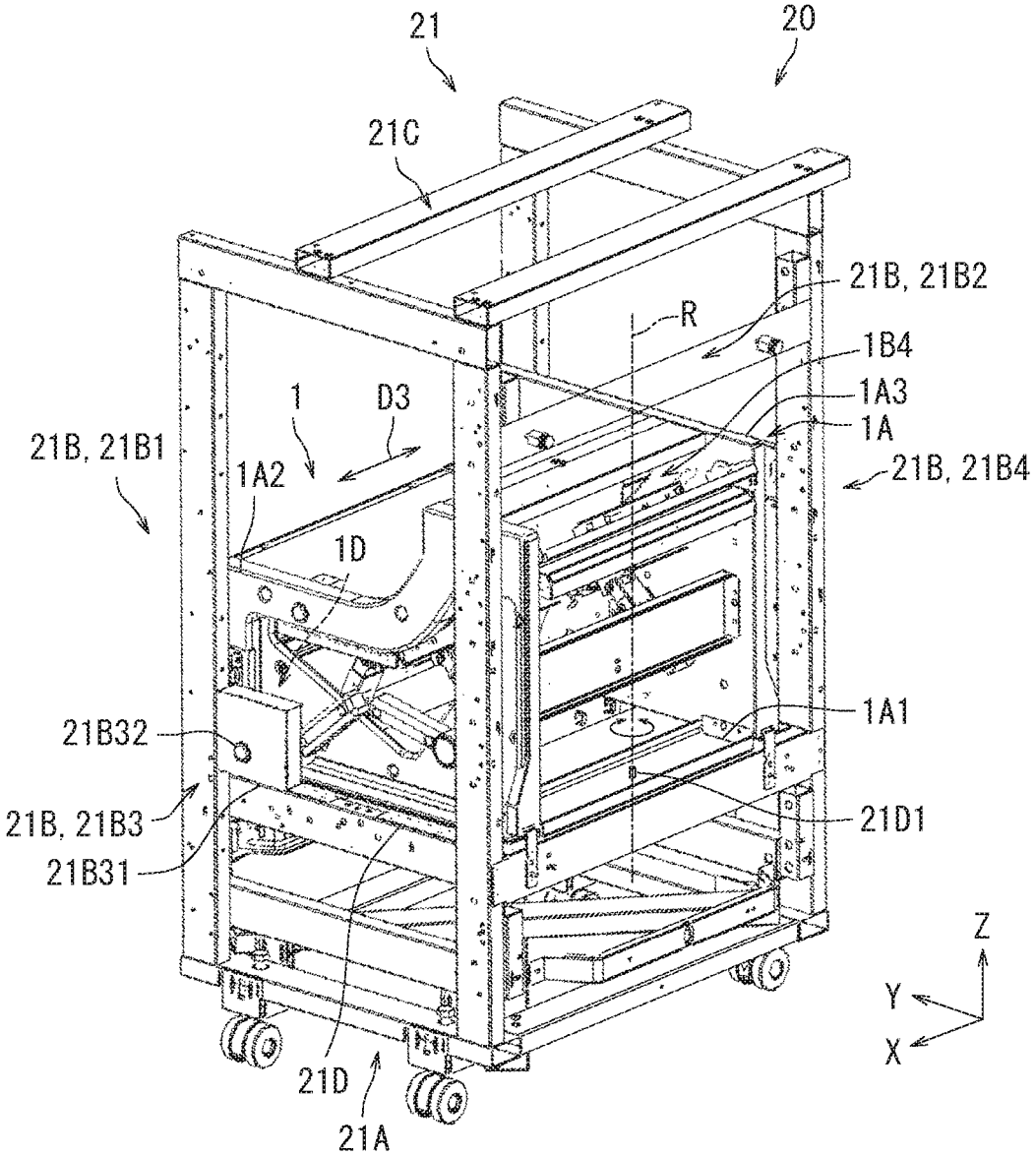
FIG. 4A is a perspective view of the relay device.

FIG. 4A is a perspective view of the relay device 20. In FIG. 4A, the relay bottom wall section 21A, the relay side wall section 21B, and the relay top wall section 21C are each shown only as respective frame members and the exterior members thereof are omitted to keep the drawing from becoming excessively complicated.

The relay side wall section 21B includes a third relay side wall section 21B3 and a fourth relay side wall section 21B4 in addition to the first relay side wall section 21B1 and the second relay side wall section 21B2 described with reference to FIG. 2.

The third relay side wall section 21B3 and the fourth relay side wall section 21B4 stand from the relay bottom wall section 21A and are opposite to each other with the conveyance unit 1 therebetween. The third relay side wall section 21B3 is located opposite to the second frame member 1A2. The third relay side wall section 21B3 includes a side plate member 21B31. The side plate member 21B31 is a rectangular plate member, for example. The side plate member 21B31 has a through hole 21B32.

Figure 4B:
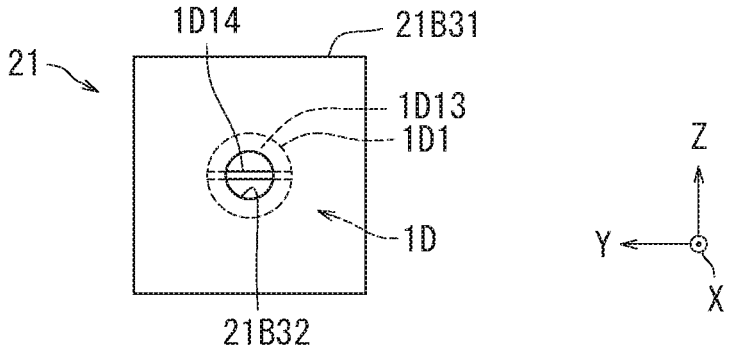
FIG. 4B is a diagram illustrating a side plate member and a rotation adjustment section of the relay device.

FIG. 4B is a diagram illustrating the side plate member 21B31 and the rotation adjustment section 1D. The side plate member 21B31 extends in a direction intersecting with the longitudinal direction of the male screw member 1D1. An end surface 1D13 of the head 1D12 has a groove 1D14.

The through hole 21B32 is opposite to the head 1D12. In detail, the diameter of the through hole 21B32 is smaller than the diameter of the end surface 1D13 of the head 1D12. The through hole 21B32 is open so as to expose the center of the end surface 1D13 and the groove 1D14.

Figure 5A:
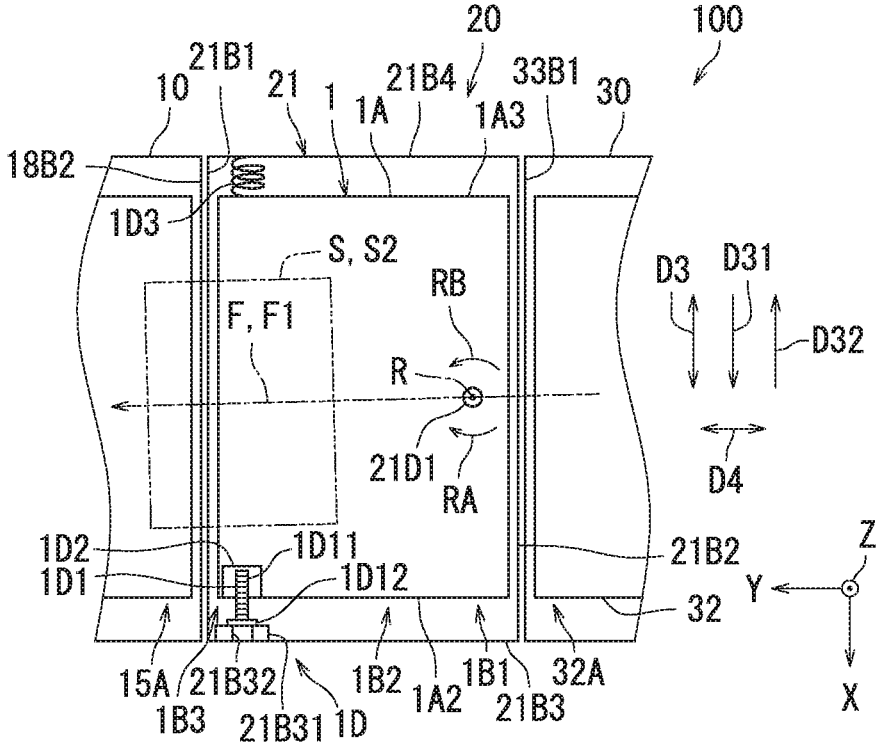
FIGS. 5A and 5B are plan views of a portion of the image forming apparatus.
Figure 5B:
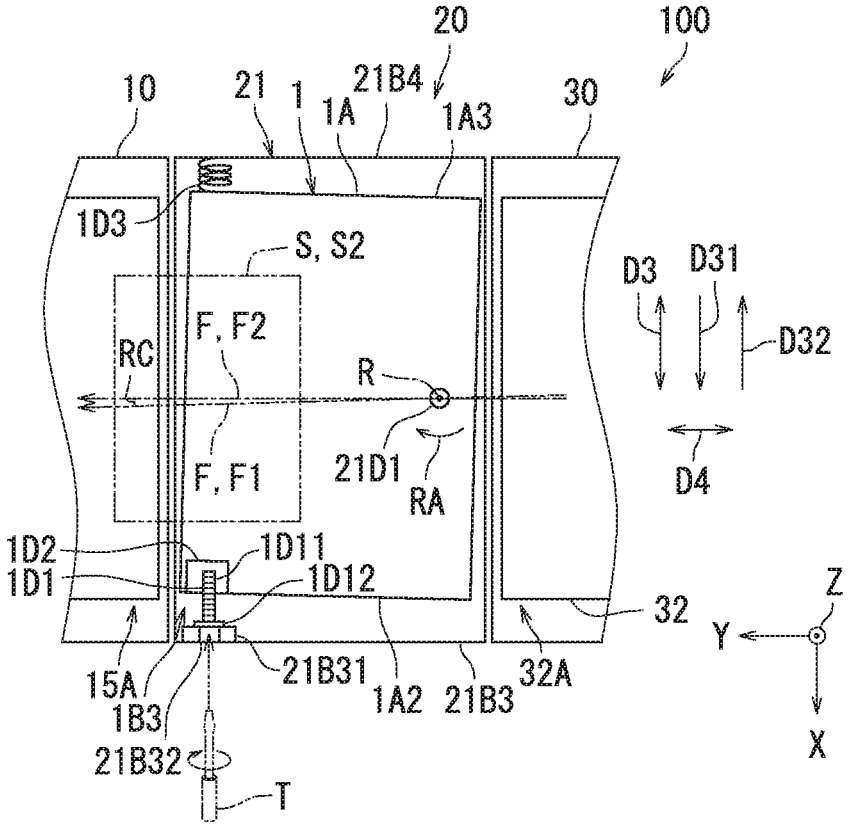

FIGS. 5A and 5B are plan views of a portion of the image forming apparatus 100. In FIGS. 5A and 5B, the female screw member 1D2 is illustrated in a simplified manner to keep the drawings from becoming excessively complicated. As illustrated in FIG. 5A, the side plate member 21B31 restricts movement of the head 1D12. In detail, the side plate member 21B31 restricts movement of the head 1D12 in a direction D31 (also referred to below as a "first rotational axis direction D31") of directions along the rotational axis direction D3 of the conveyance roller 1B4. The first rotational axis direction D31 is from the third frame member 1A3 toward the second frame member 1A2. In the following, a direction opposite to the first rotational axis direction D31 may be referred to as a "second rotational axis direction D32".

The rotation adjustment section 1D preferably includes an urging member 1D3. The urging member 1D3 urges the head 1D12 toward the side plate member 21B31. The urging member 1D3 is located on the third frame member 1A3 and opposite to the fourth relay side wall section 21B4. The configuration of the urging member 1D3 is later described with reference to FIGS. 6A and 6B.

The outward conveyance section 1B3 conveys the sheet S2 out to the main body inward conveyance section 15A in an outward conveyance direction F. The sheet S2 conveyed into the inward conveyance section 1B1 from the end portion 32A of the feeder conveyance section 32 may be inclined (skew) in the first or second rotational axis directions D31 or D32 relative to a reference direction D4. The reference direction D4 is a direction orthogonal to the rotational axis direction D3 and the axis R. For example, the sheet S2 is conveyed out in an outward conveyance direction F1 when the sheet S2 is inclined in the first rotational axis direction D31 relative to the reference direction D4.

As illustrated in FIG. 5B, the through hole 21B32 has a shape corresponding to the shape of a tool T. The tool T is a flat head screwdriver, for example. The through hole 21B32 penetrates the side plate member 21B31 such that the tool T is insertable therein. The tip of the tool T makes contact with the groove 1D14 of the head 1D12 (refer to FIG. 4B) upon being inserted into the through hole 21B32.

Upon the male screw member 1D1 rotating in a prescribed direction (counterclockwise direction, for example), the threading of the screw 1D11 and the female screw member 1D2 loosens. The threading gradually loosens and the interval between the head 1D12 and the female screw member 1D2 gradually increases as the number of times that the male screw member 1D1 is rotated in the prescribed direction increases. Through the above, the head 1D12 presses against the side plate member 21B31. As a result, the conveyance unit 1 gradually rotates in the first rotational direction RA with the axis R as a pivot thereof, against urging force of the urging member 1D3.

The outward conveyance section 1B3 changes the outward conveyance direction F according to a rotational angle RC by which the conveyance unit 1 is rotated with the axis R as a pivot thereof and conveys the sheet S2 out to the main body inward conveyance section 15A. For example, the outward conveyance section 1B3 changes the outward conveyance direction F from the outward conveyance direction F1 to an outward conveyance direction F2 according to the rotational angle RC and conveys the sheet S2 out to the main body inward conveyance section 15A.

By contrast, though not illustrated, upon the male screw member 1D1 rotating in a prescribed direction (clockwise direction, for example), the threading of the screw 1D11 and the female screw member 1D2 tightens. The threading gradually tightens as the number of times that the male screw member 1D1 is rotated in the prescribed direction increases, and the interval between the head 1D12 and the female screw member 1D2 gradually decreases. At this time, the conveyance unit 1 gradually rotates in the second rotational direction RB with the axis R as a pivot thereof because the urging member 1D3 urges the head 1D12 toward the side plate member 21B31.

Figure 6A:
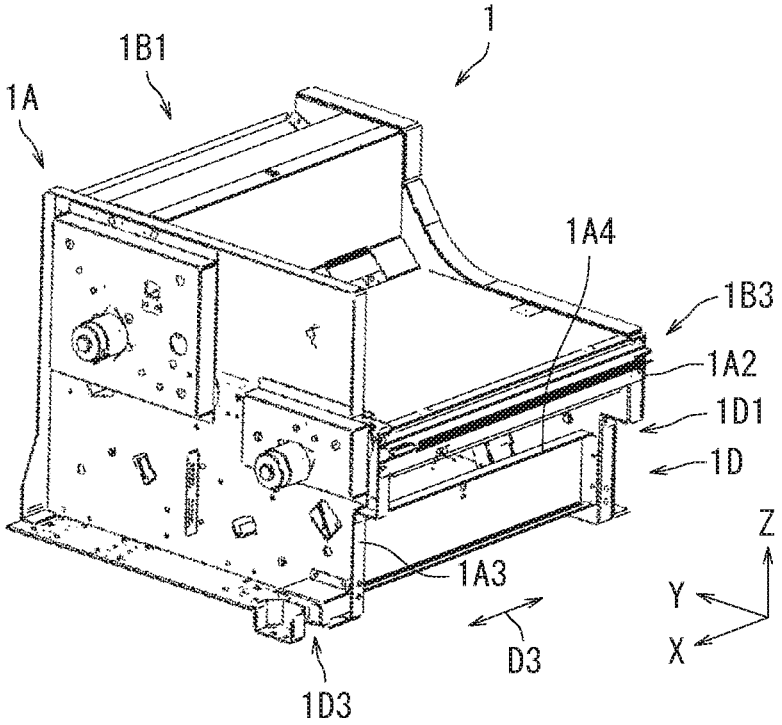
FIG. 6A is a perspective view of the conveyance unit.
Figure 6B:
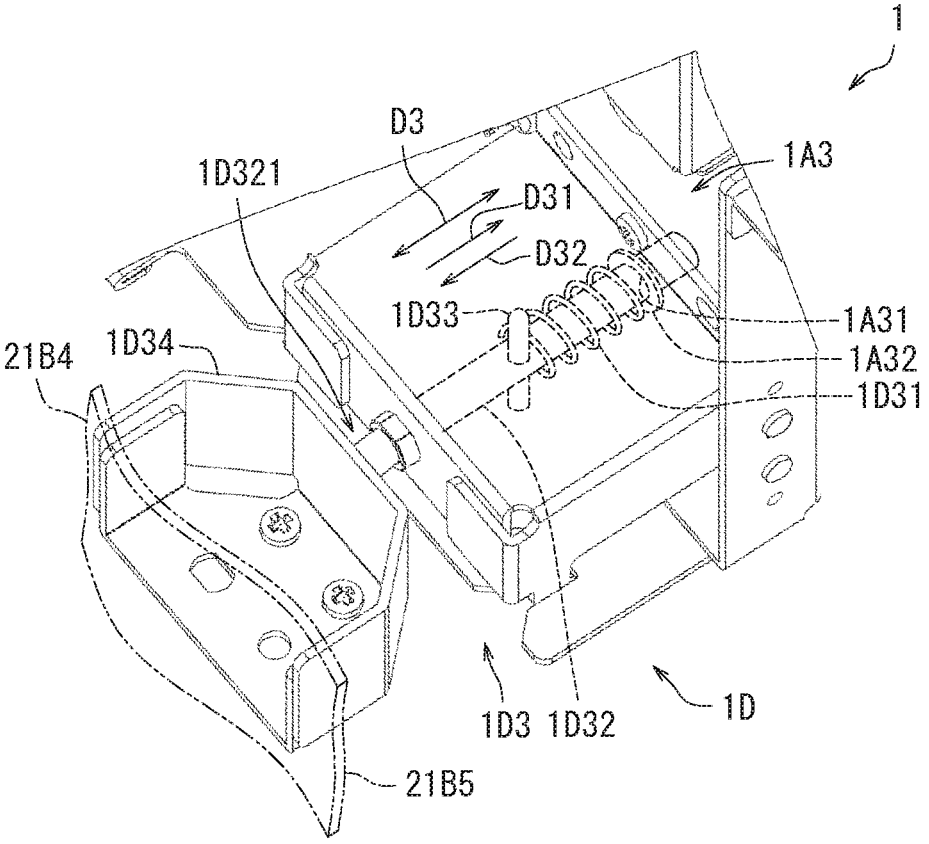
FIG. 6B is an enlarged perspective view of a portion of the conveyance unit.

FIG. 6A is a perspective view of the conveyance unit 1. FIG. 6B is an enlarged perspective view of a portion of the conveyance unit 1. As illustrated in FIG. 6A, the conveyance unit casing 1A includes a fourth frame member 1A4. The fourth frame member 1A4 extends in the rotational axis direction D3 and connects the second frame member 1A2 to the third frame member 1A3 under the outward conveyance section 1B3.

The urging member 1D3 is located under the outward conveyance section 1B3 and at a lower corner of the third frame member 1A3. That is, the urging member 1D3 is located opposite to the male screw member 1D1 and the female screw member 1D2 with the fourth frame member 1A4 therebetween.

As illustrated in FIG. 6B, the urging member 1D3 includes a compression coil spring 1D31, an urging shaft member 1D32, a protruding member 1D33, and a contact member 1D34. The urging shaft member 1D32 is inserted into the compression coil spring 1D31 in a compression direction of the compression coil spring 1D31 and flexibly supports the compression coil spring 1D31. The urging shaft member 1D32 extends from the contact member 1D34 in the first rotational axis direction D31 and penetrates a hole 1A31 of the third frame member 1A3.

The protruding member 1D33 protrudes from the urging shaft member 1D32 in a direction intersecting with the urging shaft member 1D32. The protruding member 1D33 and an outer surface 1A32 of the third frame member 1A3 restrict the movement of the compression coil spring 1D31 in the rotational axis direction D3. The compression coil spring 1D31 is freely flexible between the protruding member 1D33 and the outer surface 1A32.

The contact member 1D34 is fixed to an inner surface 21B5 of the fourth relay side wall section 21B4 and located opposite to one end 1D321 of the urging shaft member 1D32. The one end 1D321 of the urging shaft member 1D32 makes contact with the contact member 1D34. The one end 1D321 of the urging shaft member 1D32 presses against the contact member 1D34 through the compression coil spring 1D31 urging the protruding member 1D33 in the second rotational axis direction D32. Therefore, the compression coil spring 1D31 urges the outer surface 1A32 of the third frame member 1A3 in the first rotational axis direction D31.

According to the present embodiment as described above with reference to FIGS. 2 to 6B, the outward conveyance section 1B3 changes the outward conveyance direction F through the conveyance unit 1 rotating by the rotational angle RC with the axis R as a pivot thereof, and conveys the sheet S2 out to the main body 10. Accordingly, the sheet S2 can be prevented from being conveyed to the image forming section 12 in a skewed manner. As a result, positional displacement of an image formed on the sheet S2 can be prevented in a simple configuration without changing the arrangement of each device of the image forming apparatus 100.

Also according to the present embodiment, the conveyance unit 1 preferably has the insertion hole 1A11 into which the shaft member 21D1 is rotatably inserted. The conveyance unit 1 rotates in the first rotational direction RA and the second rotational direction RB with the shaft member 21D1 as a pivot thereof. Accordingly, the outward conveyance direction F of the sheet S2 can be adjusted in a simple configuration.

Also according to present embodiment, the conveyance unit 1 preferably includes the rotation adjustment section 1D. The head 1D12 presses against the side plate member 21B31 as the threading of the female screw member 1D2 and the screw 1D11 loosens. Therefore, the conveyance unit 1 rotates in the first rotational direction RA with the axis R as a pivot thereof. Accordingly, the rotation of the conveyance unit 1 can be adjusted according to a degree of threading. As a result, the rotation of the conveyance unit 1 can be precisely adjusted in a simple configuration.

Also according to the present embodiment, the rotation adjustment section 1D preferably includes the urging member 1D3. The urging member 1D3 urges the head 1D12 toward the side plate member 21B31. Therefore, the head 1D12 may maintain a state of contact with the side plate member 21B31 regardless of the threading of the female screw member 1D2 and the screw 1D11 loosening or tightening. Accordingly, the conveyance unit 1 rotates in the second rotational direction RB when the threading of the female screw member 1D2 and the screw 1D11 tightens. As a result, the conveyance unit 1 can rotate in two directions with the axis R as a pivot thereof in a simple configuration.

Also according to the present embodiment, the side plate member 21B31 preferably has the through hole 21B32. The through hole 21B32 has a shape corresponding to the shape of the tool T. Therefore, the user can rotate the male screw member 1D1 with the tool T through the through hole 21B32. Accordingly, convenience for the user adjusting the rotation of the conveyance unit 1 can be increased. Furthermore, a user not in possession of the tool T can be prevented from mistakenly rotating the conveyance unit 1.

Figure 7:
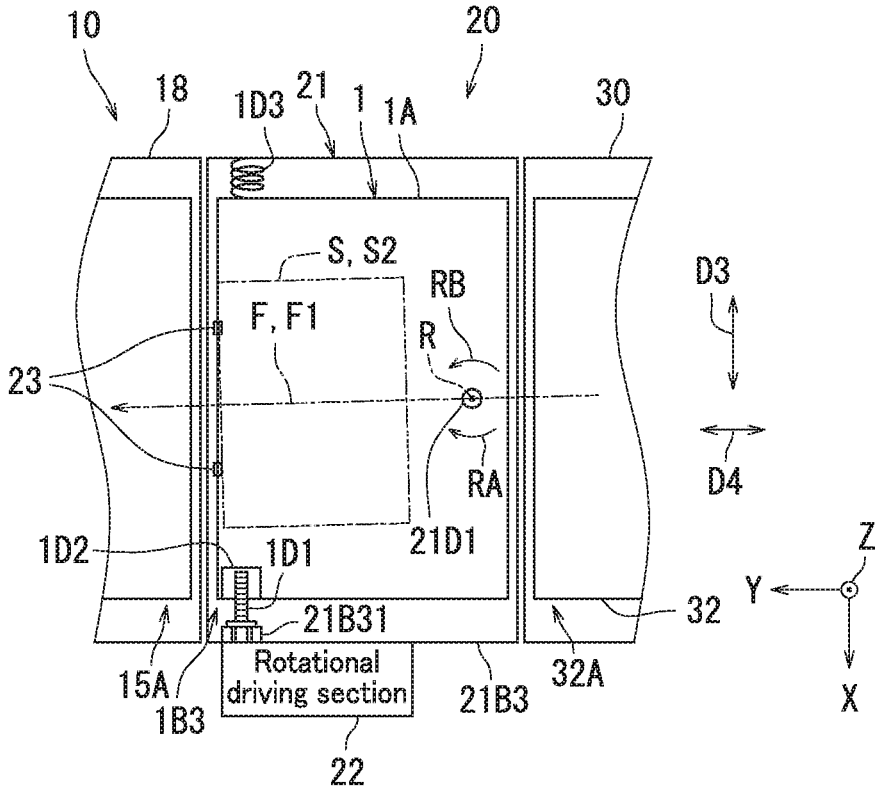
FIG. 7 is a plan view of a portion of the image forming apparatus.

As illustrated in FIG. 7, the relay device 20 may include a rotational driving section 22 and a detector 23. FIG. 7 is a plan view of a portion of the image forming apparatus 100. The rotational driving section 22 includes a driving motor and a gear, for example. The rotational driving section 22 is located on the third relay side wall section 21B3 and opposite to the side plate member 21B31. The rotational driving section 22 rotationally drives the male screw member 1D1 a prescribed number of rotations in a prescribed direction according to a control signal sent from the controller 11.

The detector 23 detects the conveyed sheet S2. In detail, the detector 23 is located on the casing 21 and opposite to the outward conveyance section 1B3. The detector 23 for example detects passage of an upstream edge of the sheet S2 in the outward conveyance direction F. The detector 23 includes two thru-beam sensors, for example. The two thru-beam sensors are for example located a prescribed interval apart in a direction orthogonal to the main surface of the side plate member 21B31. The detector 23 transmits a signal indicating a result of detection to the controller 11 upon detecting the passage of the upstream edge of the sheet S2.

The controller 11 controls the rotational driving section 22 of the relay device 20 based on the result of detection (deviation in detection timing, for example) of the detector 23. Therefore, when the sheet S2 is conveyed in a skewed manner, the conveyance direction of the conveyance unit 1 can be easily adjusted by rotating the conveyance unit 1 in a horizontal direction. Accordingly, convenience for the user adjusting the conveyance direction of the conveyance unit 1 can be further increased. Note that the detector 23 may be located on the main body casing 18 and opposite to the main body inward conveyance section 15A instead of on the casing 21 and opposite to the outward conveyance section 1B3. That is, the detector 23 may be included in at least one of the relay device 20 and the main body 10.

Figure 8:
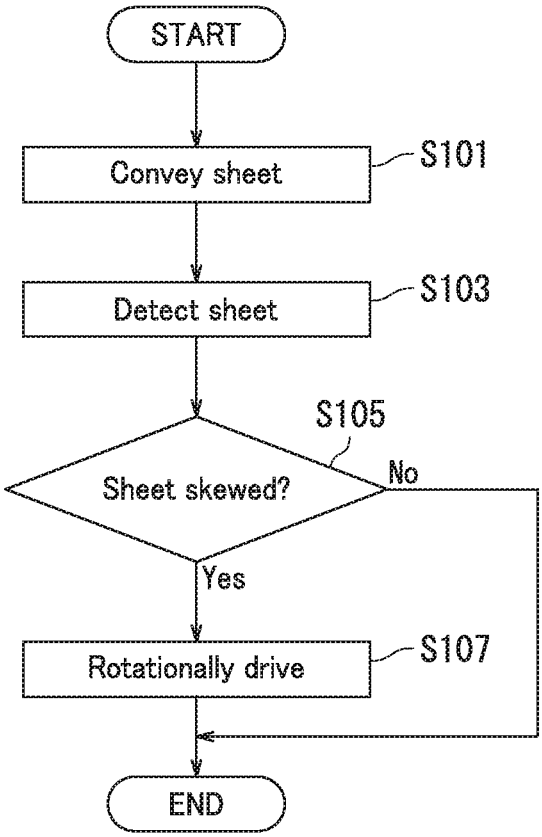
FIG. 8 is a flowchart depicting a rotation adjustment process.

The following describes operation of the rotational driving section 22 and the detector 23 with reference to FIGS. 1 to 8. FIG. 8 is a flowchart depicting a rotation adjustment process of the conveyance unit 1. By performing Steps S101 to S107, the image forming apparatus 100 performs the rotation adjustment process. Specifically, the process is as follows.

In Step S101, the relay conveyance section 1B conveys the sheet S2. The process advances to Step S103.

Next in Step S103, the detector 23 detects the conveyed sheet S2. The process advances to Step S105.

Next in Step S105, the controller 11 determines whether or not the sheet S2 skews. When the sheet S2 skews (Yes in Step S105), the process advances to Step S107. When the sheet S2 does not skew by contrast (No in Step S105), the process ends.

When an affirmative determination is made in Step S105, the rotational driving section 22 rotationally drives the male screw member 1D1 in Step S107. The process then ends.

Figure 9:
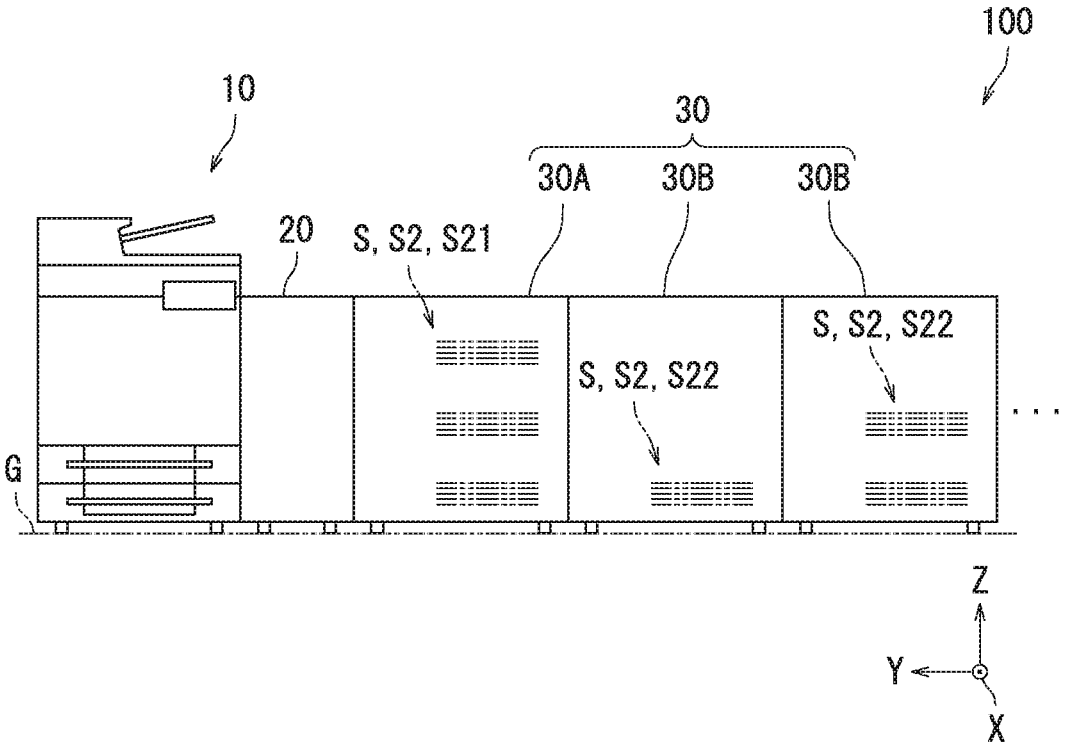
FIG. 9 is a diagram illustrating a variation of the image forming apparatus.

The following describes a variation of the image forming apparatus 100 with reference to FIGS. 1 to 8 and further reference to FIG. 9. FIG. 9 is a diagram illustrating the variation of the image forming apparatus 100. The feeder 30 is one device in the embodiment described with reference to FIGS. 1 to 8, but may be multiple devices.

Specifically, as illustrated in FIG. 9, the feeder 30 may include a first feeder 30A and at least one second feeder 30B. The first feeder 30A and the second feeder 30B may have the same configuration as each other. The first feeder 30A is connected to the relay device 20. The second feeder 30B is arranged opposite to the relay device 20 with the first feeder 30A therebetween in a direction along the placement surface G. The second feeder 30B feeds the sheet S2 (sheet S22) toward the first feeder 30A. The first feeder 30A feeds the sheet S2 (sheet S21) to the relay device 20. The first feeder 30A also conveys the sheet S22 fed from the second feeder 30B to the relay device 20. As such, the multiple feeders can be arranged side by side on the placement surface G. Accordingly, a skew of the sheet S2 fed from the feeder 30 can be easily corrected without changing the arrangement of the image forming apparatus 100 regardless of the number of arranged devices.

The embodiment of the present disclosure is described so far with reference to the accompanying drawings (FIGS. 1 to 9). However, the present disclosure is not limited to the above embodiment and may be implemented in various manners within a scope not departing from the gist of the present disclosure. Furthermore, various disclosures may be created by appropriately combining elements of configuration from multiple embodiments. For example, some of the elements of configuration illustrated in the embodiment may be removed. Additionally, elements of configuration may be appropriately combined from different embodiments. The drawings illustrate main elements of configuration schematically to facilitate understanding thereof. Aspects of the elements of configuration illustrated in the drawings, such as thickness, length, number, and interval thereof, may differ in practice for the sake of convenience for drawing preparation. Furthermore, aspects of the elements of configuration illustrated in the above embodiments, such as material and shape thereof, are one example and not particularly limited. The elements of configuration may be altered in various manners within a scope not substantially departing from the configuration of the present disclosure.

(1) As described with reference to FIGS. 1 to 9, the relay device 20 is adjacent to the main body 10 and the feeder 30, but the present disclosure is not limited as such. The relay device 20 need only change the conveyance direction of the sheet S conveyed toward the main body 10 from the feeder 30 before the sheet S reaches the main body 10. For example, various devices such as an optional device may be interposed between the main body 10 and the relay device 20 or the relay device 20 and the feeder 30.

(2) As described with reference to FIGS. 3A, 3B, and 4A, the shaft member 21D1 protrudes from the base member 21D, but the present disclosure is not limited as such. The shaft member 21D1 need only be a rotary shaft capable of rotating the conveyance unit 1. The insertion hole 1A11 may be located correspondingly to the location of the shaft member 21D1. For example, the shaft member 21D1 may protrude downward from an inner surface of the relay top wall section 21C. In such an embodiment, the insertion hole 1A11 may be formed in an upper surface of the conveyance unit casing 1A.

(3) As described with reference to FIGS. 1 to 9, the image forming apparatus 100 is an electrographic multifunction peripheral, but the present disclosure is not limited as such. The image forming apparatus 100 may be an inkjet multifunction peripheral, for example. The image forming section 12 includes a recording head in a case in which the image forming apparatus 100 is an inkjet multifunction peripheral.

(4) As described with reference to FIG. 7, the rotational driving section 22 is located on the third relay side wall section 21B3 and opposite to the side plate member 21B31, but the present disclosure is not limited as such. The rotational driving section 22 need only be capable of rotationally driving the conveyance unit 1 with the axis R as a pivot thereof. For example, the rotational driving section 22 may be located beneath the first frame member 1A1 and rotate the first frame member 1A1 with the axis R as a pivot thereof.

What is claimed is:

1. An image forming apparatus comprising:

a main body configured to form an image on a sheet;

a feeder configured to feed the sheet toward the main body; and a relay device connecting the main body to the feeder, wherein the main body is placed on a placement surface, the feeder is arranged opposite to the main body with the relay device therebetween in a direction along the placement surface, the relay device includes a conveyance unit and a casing which houses the conveyance unit, the conveyance unit conveys the sheet fed from the feeder to the main body, and rotates relative to the casing with an axis as a pivot thereof, the axis extending in a cross direction intersecting with the placement surface, the conveyance unit includes a rotation adjustment section configured to adjust rotation of the conveyance unit with the axis as a pivot thereof, the rotation adjustment section includes a male screw member and a female screw member, the male screw member includes a head and a screw extending from the head toward the female screw member, the casing includes a side plate member configured to restrict movement of the head, and the head presses against the side plate member as threading of the female screw member and the screw loosens.

2. The image forming apparatus according to claim 1, wherein the conveyance unit includes an outward conveyance section configured to convey the sheet out to the main body in an outward conveyance direction, and the outward conveyance section changes the outward conveyance direction according to a rotational angle by which the conveyance unit is rotated with the axis as a pivot thereof, and conveys the sheet out to the main body.

3. The image forming apparatus according to claim 1, wherein the casing includes a shaft member extending in a direction along the axis, and the conveyance unit has an insertion hole into which the shaft member is rotatably inserted.

4. The image forming apparatus according to claim 1, wherein the casing includes a base member onto which the conveyance unit is placed, and the conveyance unit includes a swinging member configured to swing an upper portion of the base member according to rotation with the axis as a pivot thereof.

5. The image forming apparatus according to claim 1, wherein the rotation adjustment section includes an urging member, and the urging member urges the head toward the side plate member.

6. The image forming apparatus according to claim 1, wherein the side plate member has a through hole at a location opposite to the head, and the through hole has a shape corresponding to a shape of a tool.

7. The image forming apparatus according to claim 1, wherein the relay device includes a rotational driving section configured to rotationally drive the male screw member, at least one of the relay device and the main body includes a detector configured to detect the conveyed sheet, and the main body includes a controller configured to control the rotational driving section based on a result of detection by the detector.

8. The image forming apparatus according to claim 1, wherein the feeder includes a first feeder and at least one second feeder, the first feeder is connected to the relay device, the second feeder conveys the sheet toward the first feeder, and the second feeder is arranged opposite to the relay device with the first feeder therebetween in a direction along the placement surface.

* * * * *